US008200143B2

(12) United States Patent
Shiobara

(10) Patent No.: US 8,200,143 B2
(45) Date of Patent: Jun. 12, 2012

(54) IMAGE FORMING APPARATUS WITH DETECTION UNIT

(75) Inventor: Toshimasa Shiobara, Tokyo (JP)

(73) Assignee: Oki Data Corporation, Tokyo (JP)

( * ) Notice: Subject to any disclaimer, the term of this patent is extended or adjusted under 35 U.S.C. 154(b) by 526 days.

(21) Appl. No.: 12/379,657

(22) Filed: Feb. 26, 2009

(65) Prior Publication Data

US 2009/0245819 A1 Oct. 1, 2009

(30) Foreign Application Priority Data

Mar. 28, 2008 (JP) ..... 2008-086383

(51) Int. Cl.
*G03G 15/00* (2006.01)
*G03G 15/01* (2006.01)

(52) U.S. Cl. ..... 399/397; 399/49; 399/301

(58) Field of Classification Search ..... 399/16, 399/49, 68, 397, 406, 301, 302, 303; 271/265.02, 271/265.03, 265.04, 161, 188, 209
See application file for complete search history.

(56) References Cited

U.S. PATENT DOCUMENTS

| | | | | |
|---|---|---|---|---|
| 6,564,025 | B2 * | 5/2003 | Sameshima et al. | 399/68 |
| 6,804,479 | B2 * | 10/2004 | Kimura | 399/49 |
| 7,251,426 | B2 * | 7/2007 | Koshida | 399/68 |
| 7,813,659 | B2 * | 10/2010 | Kawaguchi | 399/39 |

FOREIGN PATENT DOCUMENTS

JP 09-325544 12/1997

* cited by examiner

*Primary Examiner* — Judy Nguyen
*Assistant Examiner* — Justin Olamit
(74) *Attorney, Agent, or Firm* — Kubotera & Associates, LLC

(57) ABSTRACT

An image forming apparatus includes an image forming portion for forming an image using developer; a transfer unit for transferring the image to a medium transported thereto; a first detection unit disposed at a specific position for detecting the image thus transferred; and a second detection unit disposed to face the first detection unit for detecting a distance to the medium so that the first detection unit detects a detection result of the second detection unit.

11 Claims, 16 Drawing Sheets

IMAGE FORMING APPARATUS WITH DETECTION UNIT

BACKGROUND OF THE INVENTION AND RELATED ART STATEMENT

The present invention relates to an image forming apparatus.

In a conventional image forming apparatus, a static latent image is formed on a photosensitive drum, and the static latent image is developed with toner, thereby forming a toner image. A transfer device transfers the toner image on the photosensitive drum to a medium, and a fixing device fixes the toner image to the medium through heat and pressure.

In the conventional image forming apparatus, when a medium transport device transports the medium, the medium may be curved between, for example, the transfer device and the fixing device due to a difference in medium transport speeds. When the medium is curved excessively, the image on the sheet may contact with a component in the conventional image forming apparatus, or the medium may be wrinkled or jammed. When the medium is extended excessively, the image may be shifted, or a transport motor may be detached.

To this end, in the conventional image forming apparatus, when the medium transport device transports the medium, a slack of the medium is detected for adjusting the medium transport speed of the medium transport device or the fixing device, thereby preventing the problems described above. An example of detecting the slack of the medium includes a combination of a lever arm and a photo-coupler sensor.

Patent Reference has disclosed technology for adjusting the medium transport speed. According to Patent Reference, an image forming apparatus includes a transport unit for transporting a medium supplied thereto; an image supporting member disposed on a downstream side of the transport unit in a transport direction of the medium; a transfer unit disposed to face the image supporting member for transferring a latent image on the image supporting member to the medium; and a slack removal portion disposed between the transport unit and the transfer unit for forming a slack in the medium.

Patent Reference: Japan Patent Publication No. 09-325544

In the conventional image forming apparatus, a medium slack detection unit detects the slack of the medium through an on/off operation, thereby adjusting the medium transport speed on an upstream side or a downstream side of the slack detection unit. Accordingly, when just one medium is transported with a variance in the medium transport speed, it is difficult to properly adjust the medium transport speed according to a transport state of the medium.

As a result, the medium transport speed may vary according to a type of medium, a variance in the units, a change in a temperature of the apparatus, and the likes. That is, it is difficult to detect an excessive slack, thereby causing a winkle or a jam. When the slack is not so excessive, the medium may be accelerated excessively. Accordingly, the image may be shifted, or a transport motor may be detached, thereby making it difficult to stably obtain the transport speed.

In view of the problems described above, an object of the present invention is to provide an image forming apparatus capable of solving the problems of the conventional image forming apparatus.

Further objects of the invention will be apparent from the following description of the invention.

SUMMARY OF THE INVENTION

In order to attain the objects described above, according to an aspect of the present invention, an image forming apparatus includes an image forming portion for forming an image using developer; a transfer unit for transferring the image to a medium transported thereto; a first detection unit disposed at a specific position for detecting the image thus transferred; and a second detection unit disposed to face the first detection unit for detecting a distance to the medium so that the first detection unit detects a detection result of the second detection unit.

In the aspect of the present invention, it is possible to detect a slack amount of the medium in the image forming unit. According to the detection result of the slack amount, it is possible to stably transport the medium through controlling a medium drive motor.

DETAILED DESCRIPTION OF THE PREFERRED EMBODIMENTS

Hereunder, embodiments of the present invention will be described in detail with reference to the accompanying drawings. In the following description, the present invention is applied to a printer as an image forming apparatus having a sheet transport unit disposed therein.

First Embodiment

Figure 3:
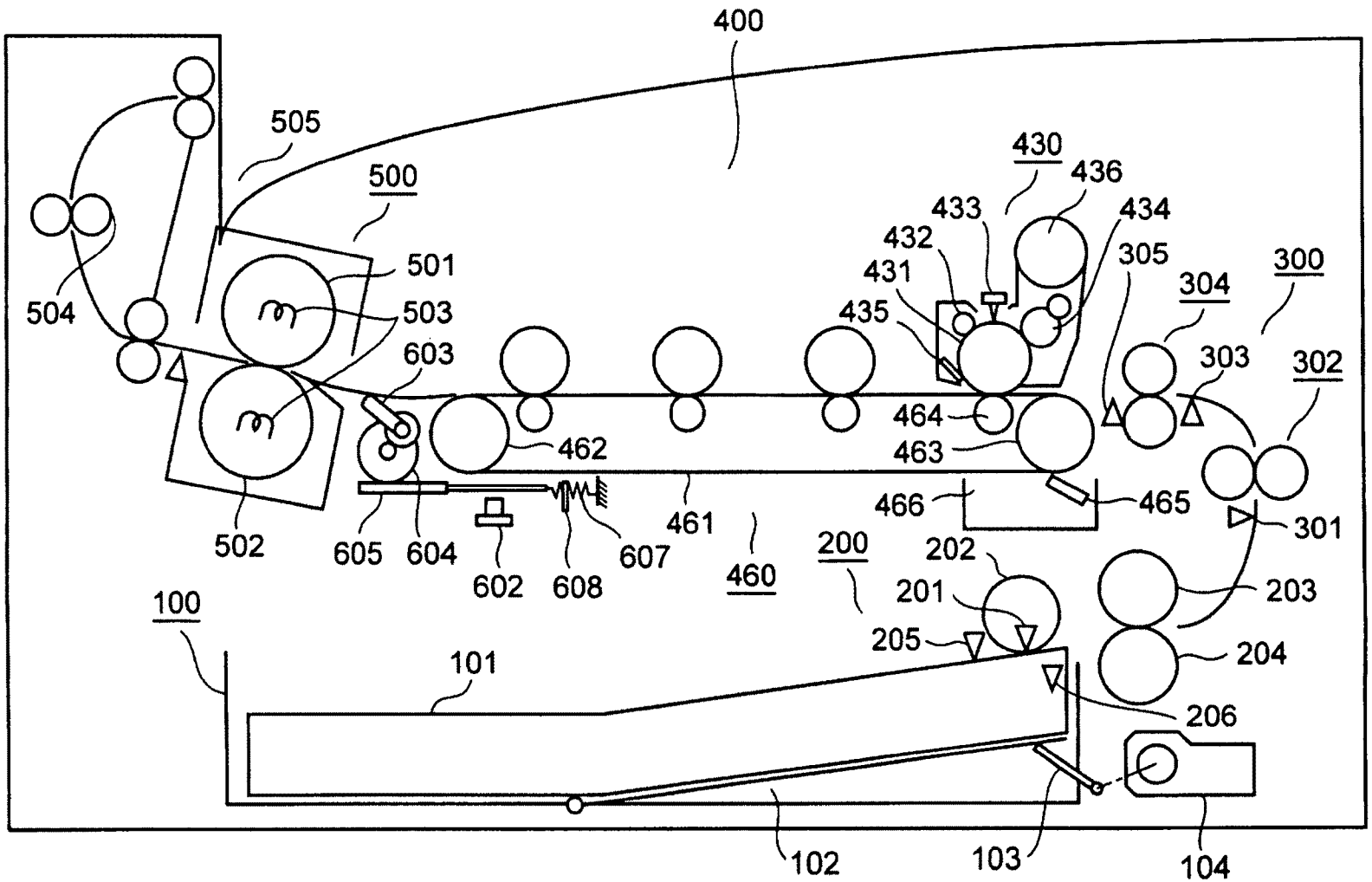
FIG. 3 is a schematic view showing a configuration of an image forming apparatus having the slack detection mechanism according to the first embodiment of the present invention.

A first embodiment of the present invention will be explained. FIG. 3 is a schematic view showing a configuration of a color electro-photography printer as an image forming apparatus according to the first embodiment of the present invention.

As shown in FIG. 3, the printer includes a medium tray 100 for stacking a medium 101 therein. A medium placing plate 102 is disposed inside the medium tray 100 for placing the medium 101 thereon, and is disposed to be rotatable with a supporting shaft.

In the embodiment, a guide member (not shown) is provided in the medium tray 100 for regulating a placing position of the medium 101. More specifically, the guide member regulates a side edge of the medium 101 in a direction perpendicular to a pullout direction of the medium 101 and the placing position of the medium 101 in the pullout direction. A lift-up lever 103 is provided on a supporting shaft to be rotatable for lifting or lowering the medium placing plate 102. A motor 104 is disposed to engage with or disengage from the supporting shaft of the lift-up lever 103 for driving the lift-up lever 103. A lift detection unit 201 is provided for detecting the medium 101 at a specific height.

In the embodiment, a medium pullout portion 200 is disposed on a pullout side of the medium tray 100 for pulling out the medium 101 one by one. The medium pullout portion 200 includes a pickup roller 202 disposed to press the medium 101 at a specific height; and a pair of rollers, i.e., a feedback roller 203 and a retard roller 204, for separating the medium 101 pulled out with the pickup roller 202 one by one. A medium detection unit 205 is disposed in the medium pullout portion 200 for detecting the medium 101. Further, a medium remaining amount detection unit 206 is disposed in the medium pullout portion 200 for detecting a remaining amount of the medium 101.

In the embodiment, a medium transport unit 300 transports the medium 101 pulled out with the medium pullout portion 200 to an image forming portion 400. A medium sensor 301 is provided for detecting the medium 101 thus pulled out. A pair of transport rollers 302 and 304 is provided for transporting the medium 101.

In the embodiment, the image forming portion 400 includes an image forming unit 430 of black, yellow, magenta, and cyan arranged in series in a medium transport direction; and a transfer unit 460 for transferring toner images formed with the image forming unit 430 to an upper surface of the medium 101 through the Coulomb force.

In the embodiment, the image forming unit 430 includes an LED (Light Emitting Diode) head 433 formed of an LED array as an exposure device for forming a static latent image on a surface of an OPC (Organic Photo Conductor) drum 431 as a static latent image supporting member; a charge roller 432 for charging the surface of the OPV drum 431; a developing roller 434 for forming a toner image on the static latent image through frictional charge; and a toner supply portion 436 for supplying toner.

In the embodiment, the transfer unit 460 includes a transfer belt 461 as an endless belt for transporting the medium 101; a drive roller 462 driven with a drive unit (not shown) to rotate for driving the transfer belt 461; a tension roller 463 paired with the drive roller 462 for extending the transfer belt 461; a transfer roller 464 disposed to face the image forming unit 430 and press the OPV drum 431 through the transfer belt 461; a cleaning blade 465 for scraping off and cleaning toner attached to the transfer belt 461; and a toner box 466 for collecting toner scraped off with the cleaning blade 465.

In the embodiment, the printer further includes a fixing unit 500 for fixing the toner image transferred to the medium 101 at the transfer unit 460 to the medium 101 through heat and pressure. The fixing unit 500 includes a halogen lamp 503 as a heat source, and a pair of rollers, i.e., an upper roller 501 and a lower roller 502 having surfaces formed of an elastic material.

In the embodiment, the printer further includes a discharge roller pair 504 for discharging the medium 101 fixed at the fixing unit 500; a stacker 505 for placing the medium 101 thus printed; and a density sensor 602 for detecting a density of the image formed on the transfer belt 461 in the image forming portion 400. The density sensor 602 is capable of obtaining an output according to a density of the image thus printed.

Figure 1:
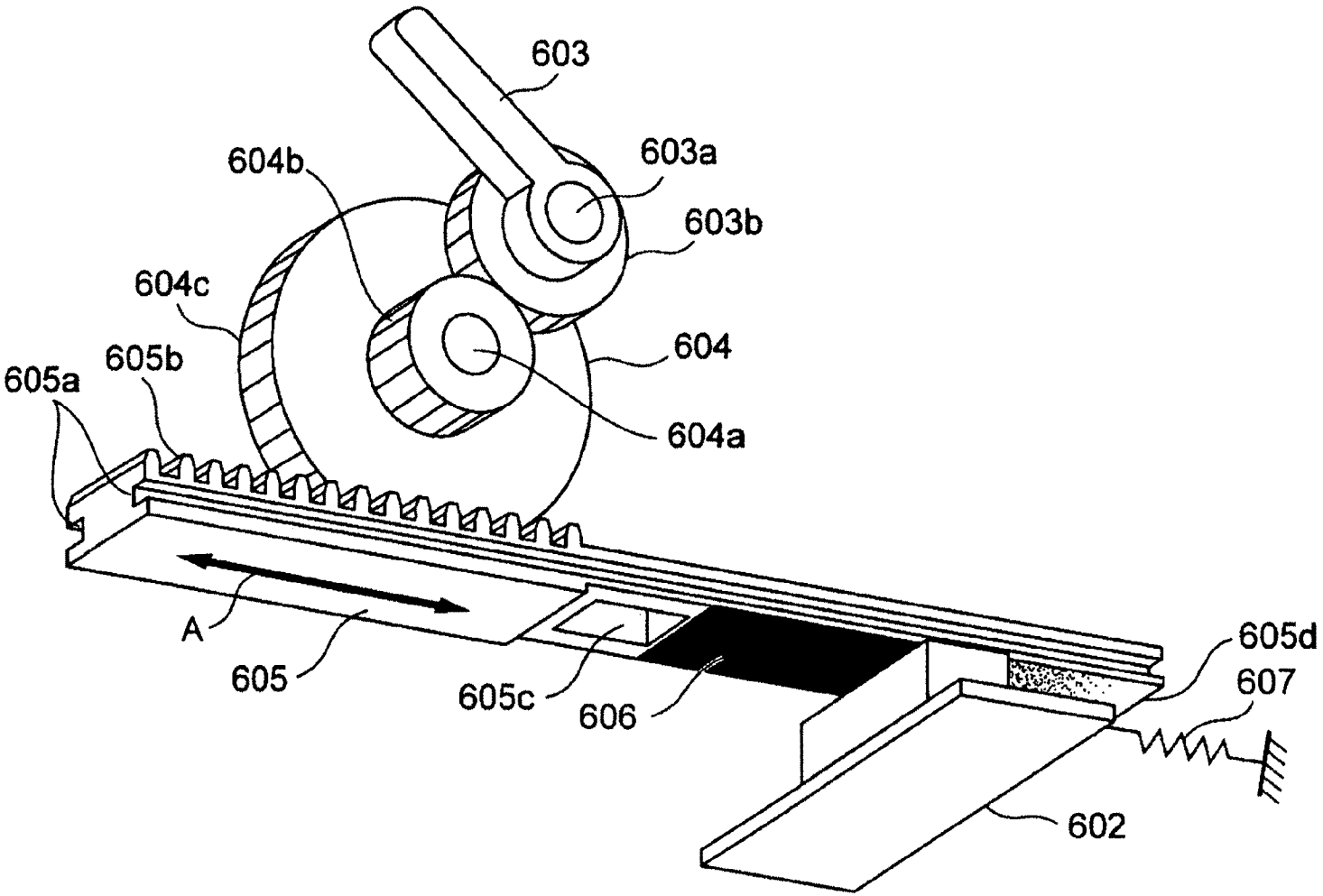
FIG. 1 is a schematic perspective view showing a configuration of a slack detection mechanism according to a first embodiment of the present invention.

A configuration of a slack detection mechanism will be explained next. FIG. 1 is a schematic perspective view showing the configuration of the slack detection mechanism according to the first embodiment of the present invention. FIG. 3 is a schematic view showing a configuration of the image forming apparatus having the slack detection mechanism according to the first embodiment of the present invention.

In the embodiment, the slack detection mechanism is disposed at a substantially center potion of a medium transport path in a direction perpendicular to the transport direction of the medium 101, or a substantially center potion of the medium 101 in a width direction thereof, for detecting a slack of the medium 101 in the medium transport path between the fixing unit 500 and the transfer unit 460. The medium 101 passes through at a substantially center potion of the medium transport path, so that the slack detection mechanism is capable of detecting the slack of the medium 101 having various sizes.

As shown in FIG. 1, the slack detection mechanism includes a sensor lever 603 to be movable according to a slack amount of the medium 101 in the medium transport path between the fixing unit 500 and the transfer unit 460. A rotational shaft 603*a* supports the sensor lever 603 to be rotatable. The sensor lever 603 is provided with a gear portion 603*b* for transmitting rotation of the sensor lever 603.

In the embodiment, a deceleration gear 604 is provided for transmitting the rotation of the sensor lever 603. The deceleration gear 604 is supported on a rotational shaft 604*a* to be freely rotatable, and a gear portion 604*b* is integrated with a gear portion 604*c*. The gear portion 604*b* engages the gear portion 603*b* formed on the sensor lever 603.

In the embodiment, a sensor plate 605 is disposed to be movable according to the rotation of the sensor lever 603.

Guide grooves 605*a* are guided with a guide rib provided on a main body (not shown) of the image forming apparatus, so that the guide grooves 605*a* are supported to slide in an arrow direction A shown in FIG. 1. A rack portion 605*b* engages the deceleration gear 604 to move the sensor plate 605 according to the rotation of the sensor lever 603 through the deceleration gear 604.

When the density sensor 602 detects the density of the image formed on the transfer belt 461 in the image forming portion 400, the density sensor 602 reads a density correction pattern formed on the transfer belt 461 through a rectangular hole 605*c*. The rectangular hole 605*c* is situated at a position facing the density sensor 602 in a state that the medium 101 is not situated in the image forming portion 400.

In the embodiment, an urging member 607 is provided for urging the sensor plate 605 toward the right direction in FIG. 3. A stopper 608 is provided on a frame (not shown) of the image forming apparatus at a position to abut against a distal end portion of the sensor plate 605. Further, the stopper 608 is situated at a position such that the density sensor 602 faces the rectangular hole 605*c* of the sensor plate 605 in a state that the distal end portion of the sensor plate 605 abuts against the stopper 608.

Figure 2A:
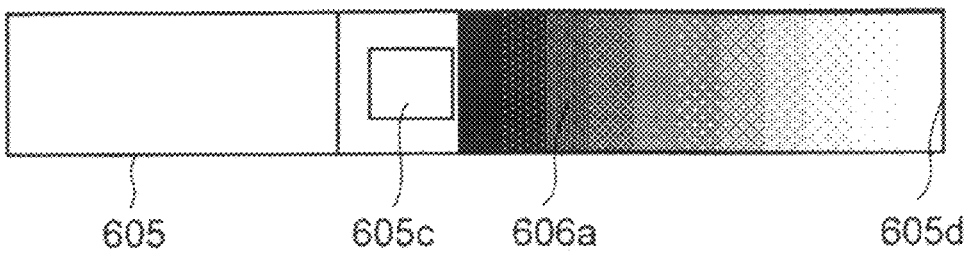
FIGS. 2(*a*) and 2(*b*) are schematic views showing a component of the slack detection mechanism according to the first embodiment of the present invention, wherein FIG. 2(*a*) is a schematic view showing the component, and FIG. 2(*b*) is a schematic view showing a modified example of the component.
Figure 2B:
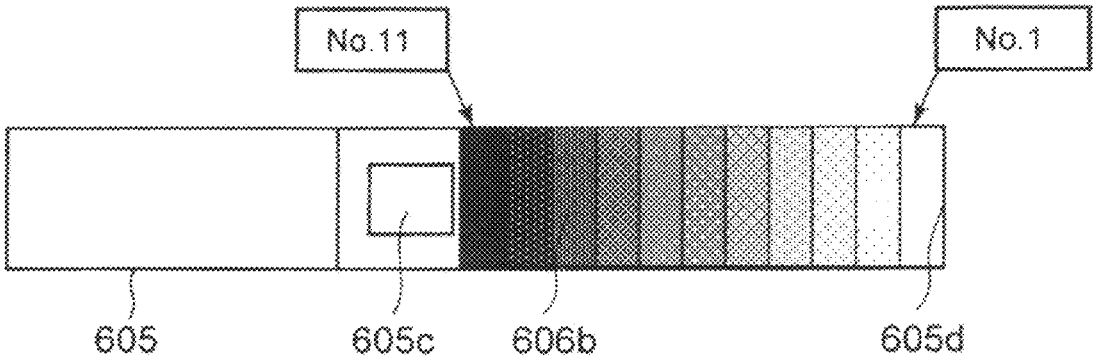

FIGS. 2(*a*) and 2(*b*) are schematic views showing the density sensor 602 of the slack detection mechanism according to the first embodiment of the present invention. More specifically, FIG. 2(*a*) is a schematic view showing a density patch 606*a*, and FIG. 2(*b*) is a schematic view showing a density patch 606*b*. As shown in FIG. 2(*a*), the density patch 606*a* has a pattern having a density gradually changing. As shown in FIG. 2(*b*), the density patch 606*b* has a pattern having a density changing stepwise.

Note that the density patch 606*a* shown in FIG. 2(*a*) has the pattern with a step in the density, and the actual pattern does not have the step. The density patch 606 is attached to the sensor plate 605 at a position facing the sensor lever 603, so that the density thereof changes in the movable direction of the sensor plate 605.

In the embodiment, the density patch 606 has the pattern having the density gradually increasing from an edge portion 605*d* of the sensor plate 605 on a side thereof where the density patch 606 is attached toward the rectangular hole 605*c*. When the density of the pattern at the position facing the density sensor 602 is high, it is indicated that the medium 101 is loosen. When the density of the pattern at the position facing the density sensor 602 is low, it is indicated that the medium 101 is extended. An operation of the sensor plate 605 will be explained later.

An operation of the image forming apparatus will be explained next with reference to FIG. 3. When an operator places the medium 101 in the medium tray 100 and inserts the medium tray 100 into the image forming apparatus, the lift-up lever 103 engages the motor and a control unit (not shown) drives the motor 104. When the lift-up lever 103 rotates, the distal end portion of the lift-up lever 103 lifts up a bottom portion of the medium placing plate 102, thereby lifting the medium 101 placed on the medium placing plate 102. When the medium 101 rises up to the height for contacting with the pickup roller 202, the lift detection unit 201 detects the medium 101, so that the control unit (not shown) stops the motor according to detection information.

In the next step, an image processing unit (not shown) processes image data, and a print instruction is sent to the control unit. A drive motor (not shown) drives the pickup roller 202 to rotate, so that the pickup roller 202 picks up and transports the medium 101 to a nip position between the feed roller 203 and the retard roller 204, thereby separating the medium 101 one by one. After the medium pullout portion 200 separates the medium 101 one by one, the medium 101 is transported to the medium transport unit 300. Then, the medium 101 passes through the medium sensor 301, and is transported to the transport roller 302. The control unit controls a drive portion (not shown) to drive the transport roller 302 to transport the medium 101 according to a passing time of the medium sensor 301.

At this moment, the transport roller 302 generally starts rotating slightly after the medium 101 passes through the medium sensor 301. Accordingly, the medium 101 is pushed into a pressing portion of the transport roller 302, thereby correcting skew of the medium 101. After the transport roller 302 transports the medium 101, the medium 101 passes through a medium sensor 303 and is transported to the transport roller 304. A drive portion (not shown) drives the transport roller 304 to rotate when the medium 101 passes through the medium sensor 303, so that the medium 101 is transported without stopping. After the transport roller 304 transports the medium 101, the medium 101 passes through a medium sensor 305 and is transported to the image forming portion 400.

In the image forming portion 400, the LED head 433 irradiates the surface of the OPC drum 431 according to the image data sent from the image processing unit (not shown), thereby forming the static latent image on the surface of the OPC drum 431 charged with the charge roller 432. The toner supply portion 436 supplies toner, so that the developing roller 434 forms the toner image on the OPC drum 431. The toner image supported on the OPC drum 431 is attached to the transfer roller 464 through static electricity, and is transferred to the medium 101 at a pressing portion thereof with the transfer roller 464.

A drive portion (not shown) drives the drive roller 462 to move the transfer belt 461, so that the transfer belt 461 adheres to and transports the medium 101. In the image forming unit 430, the OPC drum 431 is driven in synchronization with the transfer belt 461. Accordingly, the toner image is sequentially transferred to the medium 101 attached to the transfer belt 461 through static electricity.

After the toner image is transferred to the medium 101 in the image forming portion 400, the medium 101 is transported to the fixing unit 500, so that the toner image is melt and fixed to the medium 101 through applying heat and pressure to the toner image on the medium 101. Afterward, the discharge roller pair 504 discharges the medium 101 to the stacker 505. In the image forming apparatus, the density sensor 602 detects a print density formed on the transfer belt 461 at a specific timing, thereby correcting the print density to be at a constant level.

An operation of detecting the slack of the medium 101 will be explained next.

Figure 4:
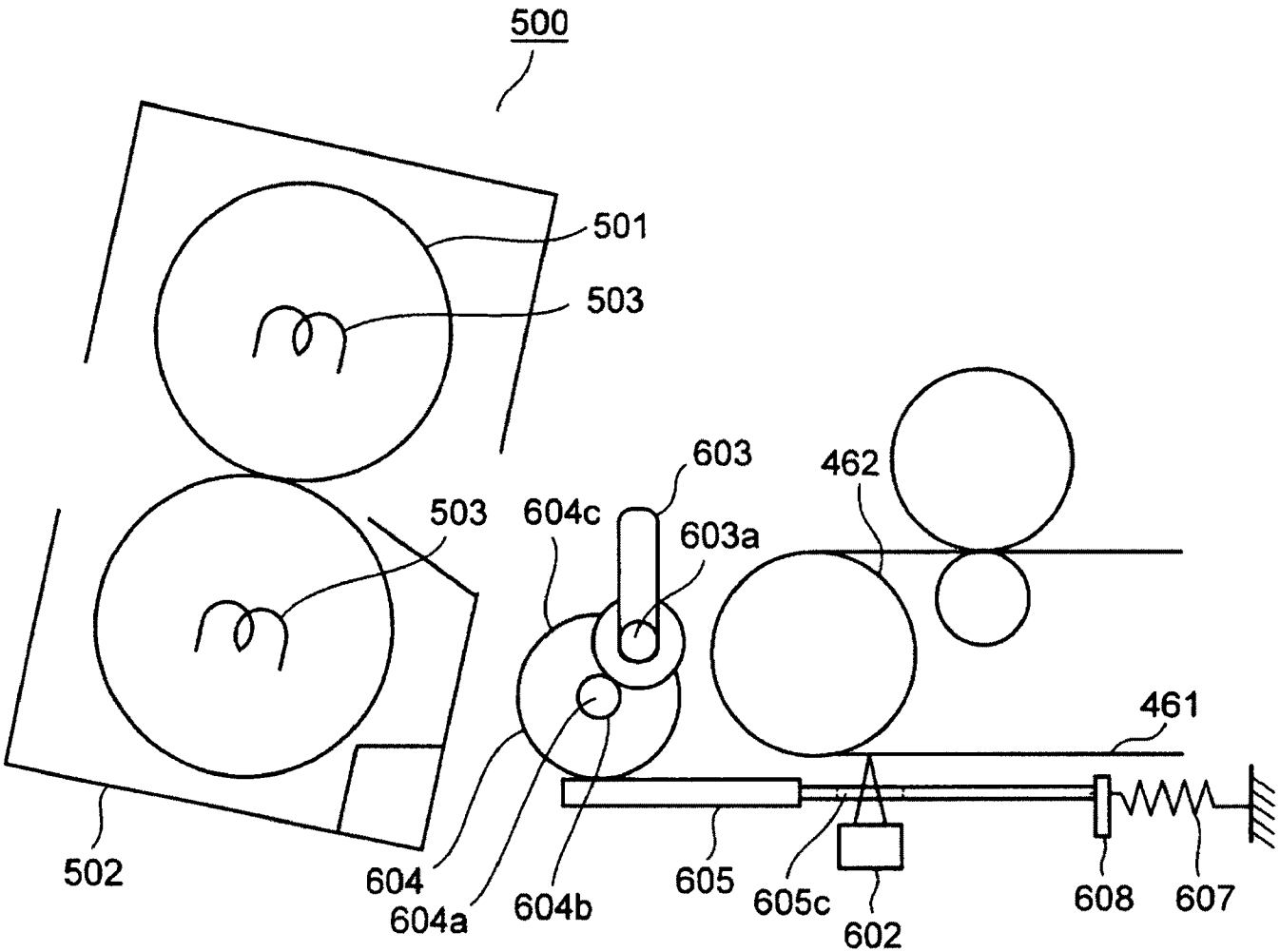
FIG. 4 is a schematic view No. 1 showing an operation of the slack detection mechanism according to the first embodiment of the present invention.
Figure 5:
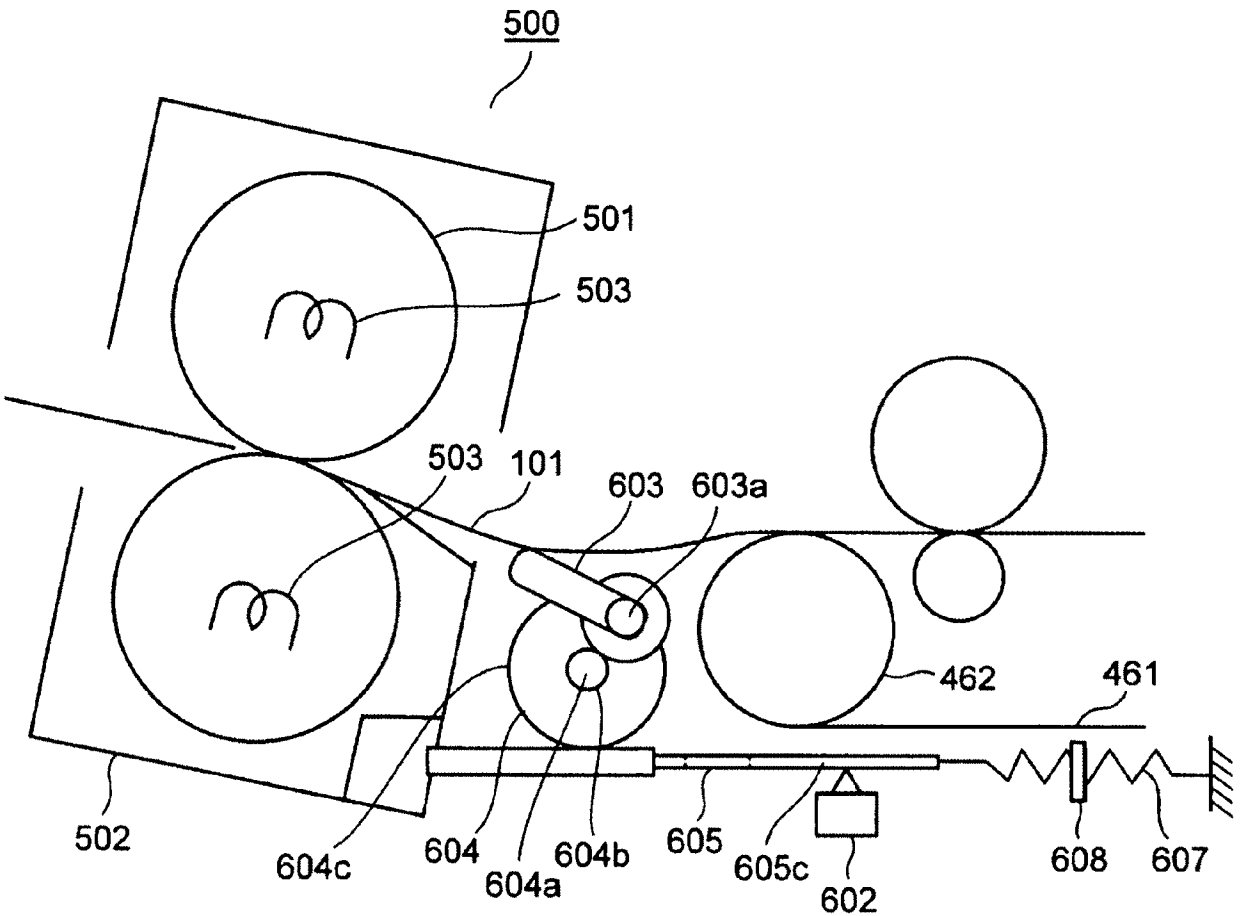
FIG. 5 is a schematic view No. 2 showing the operation of the slack detection mechanism according to the first embodiment of the present invention.
Figure 6:
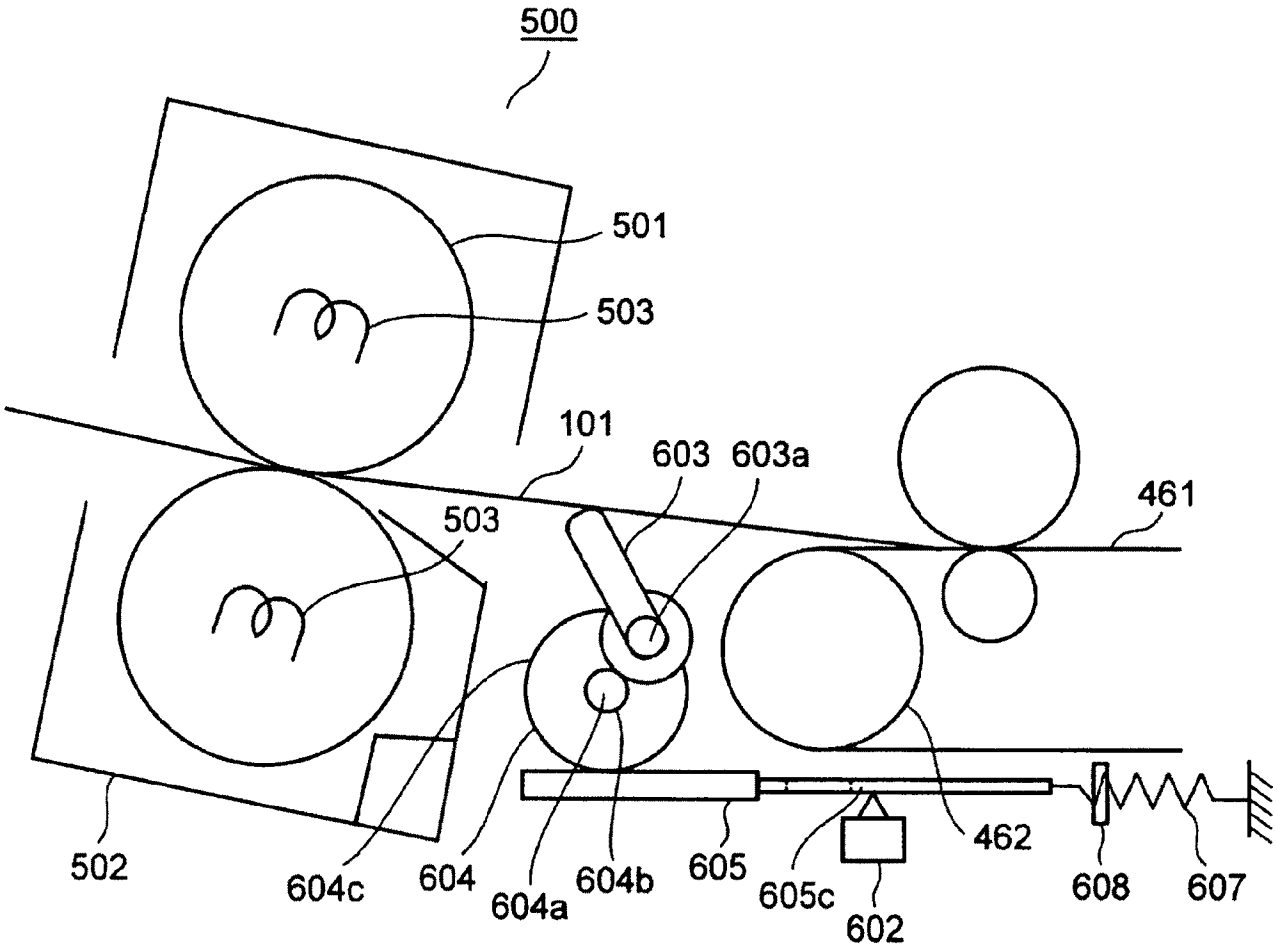
FIG. 6 is a schematic view No. 3 showing the operation of the slack detection mechanism according to the first embodiment of the present invention.

FIG. 1 is the schematic perspective view showing the configuration of the slack detection mechanism according to the first embodiment of the present invention. FIG. 4 is a schematic view No. 1 showing an operation of the slack detection mechanism according to the first embodiment of the present invention. FIG. 5 is a schematic view No. 2 showing the operation of the slack detection mechanism according to the first embodiment of the present invention. FIG. 6 is a schematic view No. 3 showing the operation of the slack detection mechanism according to the first embodiment of the present invention.

FIG. 4 is the schematic view showing a state of the slack detection mechanism in a density correction operation when the medium 101 is not situated between the image forming portion 400 and the fixing unit 500. In the state, the distal end portion of the sensor plate 605 abuts against the stopper 608. At this moment, the density sensor 602 is situated at the position facing the rectangular hole 605*c* formed in the sensor plate 605, so that no blocking object is situated between the density sensor 602 and the transfer belt 461. In the image forming apparatus, the image forming unit 430 forms a specific density detection pattern on the transfer belt 461, and the density sensor 602 detects the density detection pattern, thereby performing the density correction operation.

FIGS. 5 and 6 are the schematic views showing the operation of detecting the slack of the medium 101. When the medium 101 is transported from the image forming portion 400 and reaches the sensor lever 603, the medium 101 pushes the sensor lever 603 to rotate in the transport direction of the medium 101. When the sensor lever 603 rotates or is inclined, the deceleration gear 604 rotates to move the sensor plate 605. When the sensor plate 605 moves, the density sensor 602 faces the density patch 606 attached to the sensor plate 605.

In the next step, the density sensor 602 detects the density of the density patch 606, thereby detecting a rotational amount of the sensor lever 603 according to the density thus detected. FIG. 5 is the schematic view showing a state that the medium 101 thus transported is loosen between the image forming portion 400 and the fixing unit 500. FIG. 6 is the schematic view showing a state that the medium 101 thus transported is extended between the image forming portion 400 and the fixing unit 500.

Figure 7:
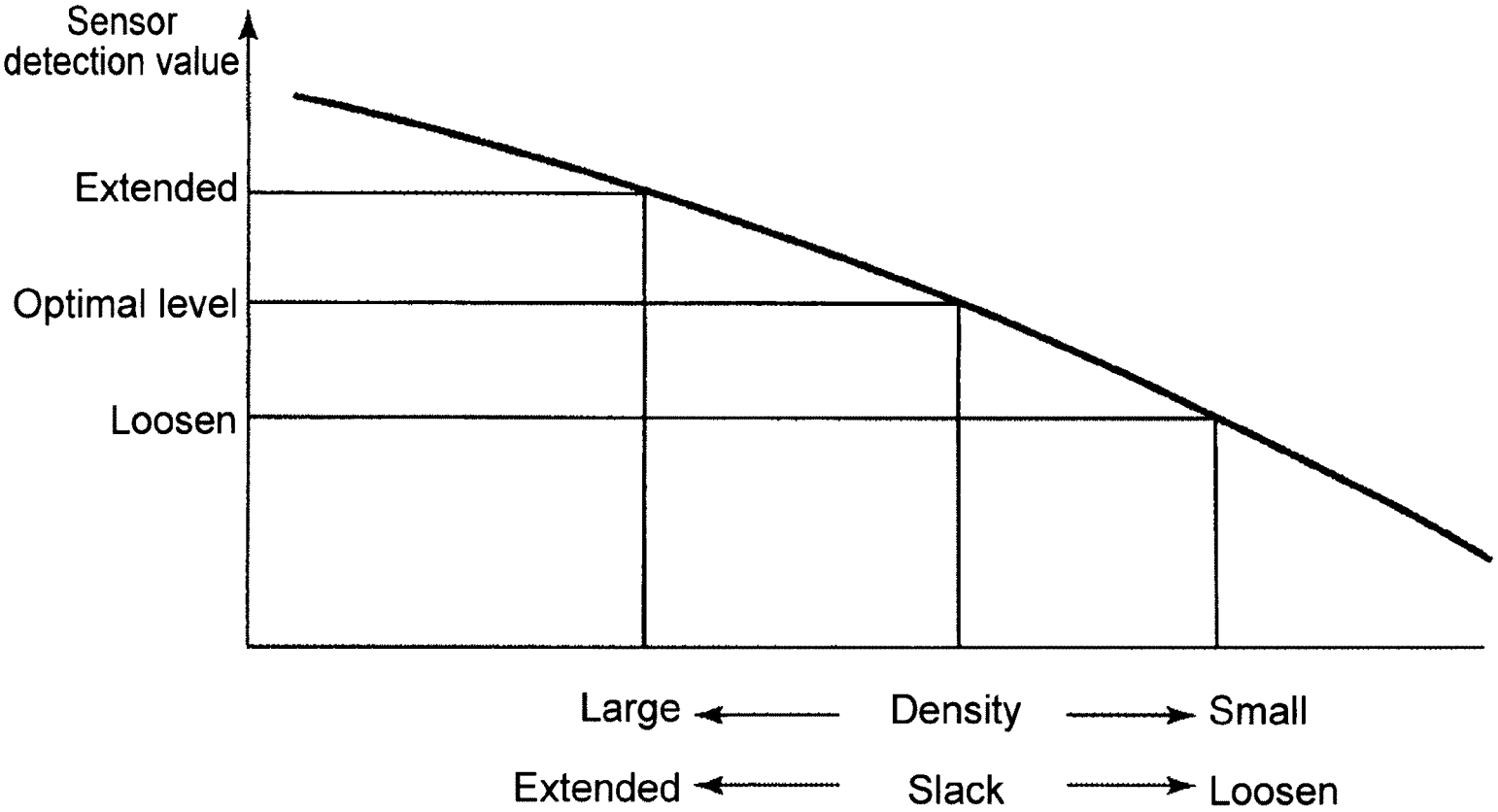
FIG. 7 is a graph showing a relationship between a detection voltage value of a density sensor and a density patch according to the first embodiment of the present invention.

FIG. 7 is a graph showing a relationship between a detection voltage value of the density sensor 602 and the density patch 606 according to the first embodiment of the present invention. As shown in FIG. 7, the detection voltage value of the density sensor 602 changes according to the density of the density patch 606, thereby making it possible to detect a moving amount of the sensor plate 605. Accordingly, it is possible to detect the rotational amount of the sensor lever 603, thereby detecting the slack amount of the medium 101.

Figure 8:
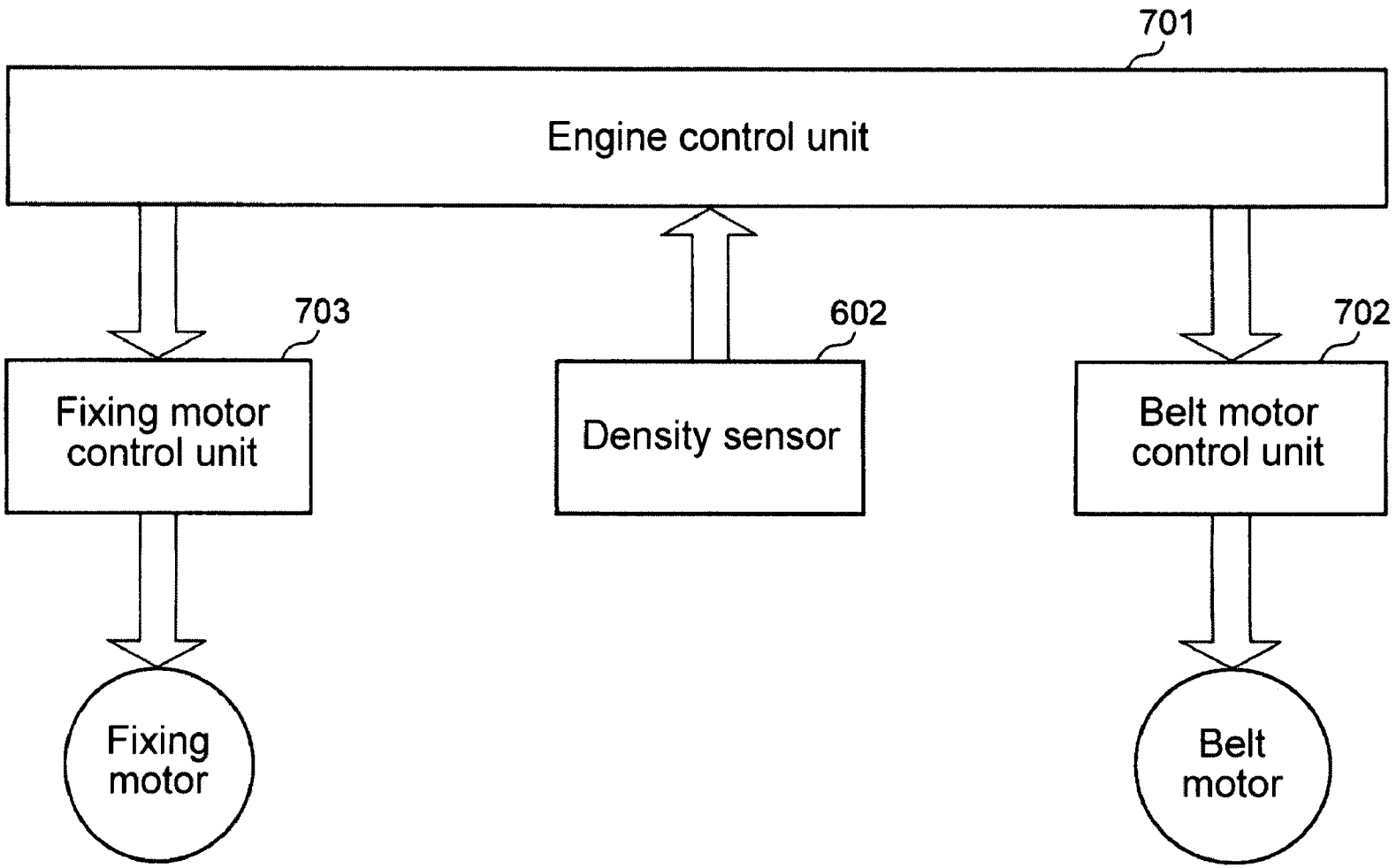
FIG. 8 is a block diagram showing the slack detection mechanism according to the first embodiment of the present invention.

FIG. 8 is a block diagram showing the slack detection mechanism according to the first embodiment of the present invention. As described above, the image processing unit (not shown) processes the image data, and the print instruction is sent to an engine control unit 701. At this moment, a transport speed Vf of the fixing unit 500 is set to a value slightly smaller than a transport speed Vb of the transfer belt 461. Accordingly, in the image forming portion 400, when the toner image is transferred from the OPC drum 431 to the medium 101 on the transfer belt 461, it is possible not to apply a load to the medium 101, thereby not generating a transfer position shift in the toner image.

When the medium 101 reaches the sensor lever 603 for detecting the slack of the medium 101, the density sensor 602 detects the density detection value. In the image forming apparatus, it is configured that the density sensor 602 periodically detects the density detection value, so that an optimal slack amount of the medium 101 is determined according to the density detection value. Then, the transport speed Vf is adjusted to obtain the optimal slack amount.

Table shows a relationship between a sensor output level and an adjustment amount in the transport speed Vf.

TABLE

| No. | Sensor output level | Adjustment amount of transport speed Vf | State of medium |
|---|---|---|---|
| 1 | −5 | −0.25% | Extended |
| 2 | −4 | −0.20% | |
| 3 | −3 | −0.15% | |
| 4 | −2 | −0.10% | |
| 5 | −1 | −0.05% | |
| 6 | 0 | 0.00% | Normal |
| 7 | 1 | 0.05% | Loosen |
| 8 | 2 | 0.10% | |
| 9 | 3 | 0.15% | |
| 10 | 4 | 0.20% | |
| 11 | 5 | 0.25% | |

As shown in Table, the sensor output levels are classified to levels, and the slack amount corresponding to a specific level is feedback to the transport speed Vf of the fixing unit 500, thereby performing a constant value control to maintain the slack amount at a constant level. A control table of the transport speed Vf such as Table shown above may be stored in a non-volatile memory portion (not shown) in the image forming apparatus, so that the engine control unit 701 retrieves the control table as necessary. Note that the engine control unit 701 includes a calculation unit (not shown) for classifying the density detection value detected with the density sensor 602.

As described above, the control table may be retrieved from the non-volatile memory portion. Alternatively, the engine control unit 701 may calculate the transport speed Vf using a specific conversion formula from the density detection value detected with the density sensor 602 at a specific timing.

As described above, in the image forming apparatus in the embodiment, the density sensor 602 detects the slack amount of the medium 101. Accordingly, it is not necessary to periodically adjust the medium transport speed, that is, it is possible to adjust the medium transport speed according to the slack amount of the medium 101.

Accordingly, even when the medium transport speed is shifted due to a change in a temperature of the image forming apparatus, it is possible to prevent the medium from being winkled or jammed due to an excessive slack thereof. Further, it is possible to prevent the image from being shifted due to excessive extension of the medium, or to prevent a transport motor from being detached. Still further, the density sensor 602 functions as the detection unit for detecting the slack of the medium 101, thereby making it possible to stably transport the medium 101 without increasing cost.

Second Embodiment

Figure 9:
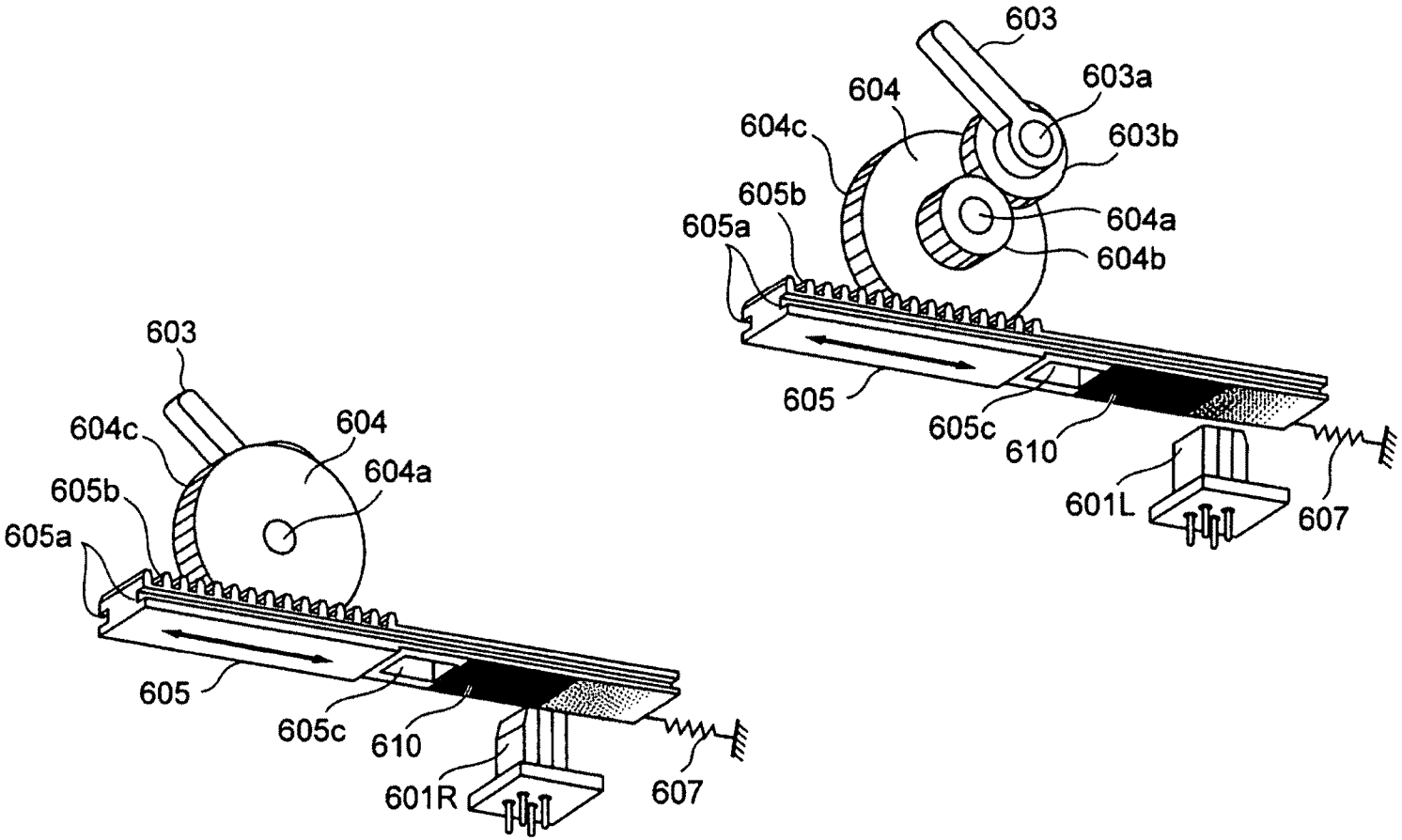
FIG. 9 is a schematic view showing a configuration of a slack detection mechanism according to a second embodiment of the present invention.
Figure 10A:
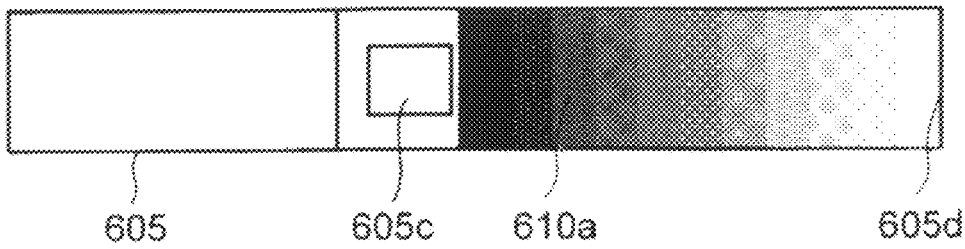
FIGS. 10(*a*) and 10(*b*) are schematic views showing a component of the slack detection mechanism according to the second embodiment of the present invention, wherein FIG. 10(*a*) is a schematic view showing the component, and FIG. 10(*b*) is a schematic view showing a modified example of the component.
Figure 10B:
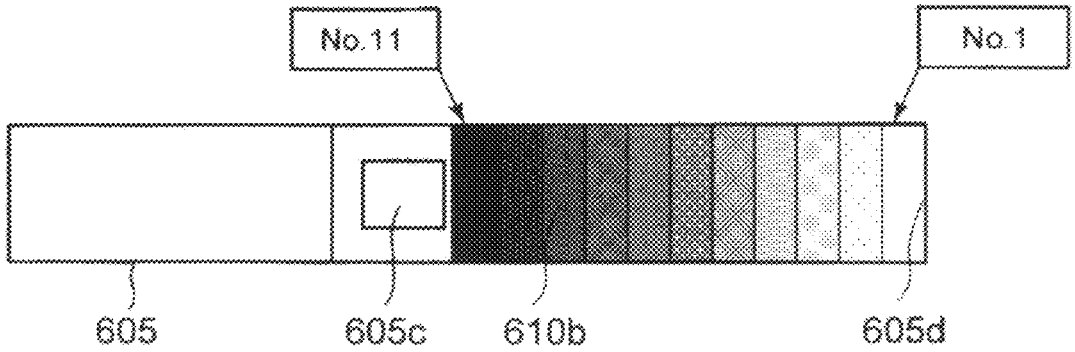

A second embodiment of the present invention will be explained next. FIG. 9 is a schematic view showing a configuration of a slack detection mechanism according to the second embodiment of the present invention. FIGS. 10(*a*) and 10(*b*) are schematic views showing a component of the slack detection mechanism according to the second embodiment of the present invention. More specifically, FIG. 10(*a*) is a schematic view showing the component, and FIG. 10(*b*) is a schematic view showing a modified example of the component.

Figure 11:
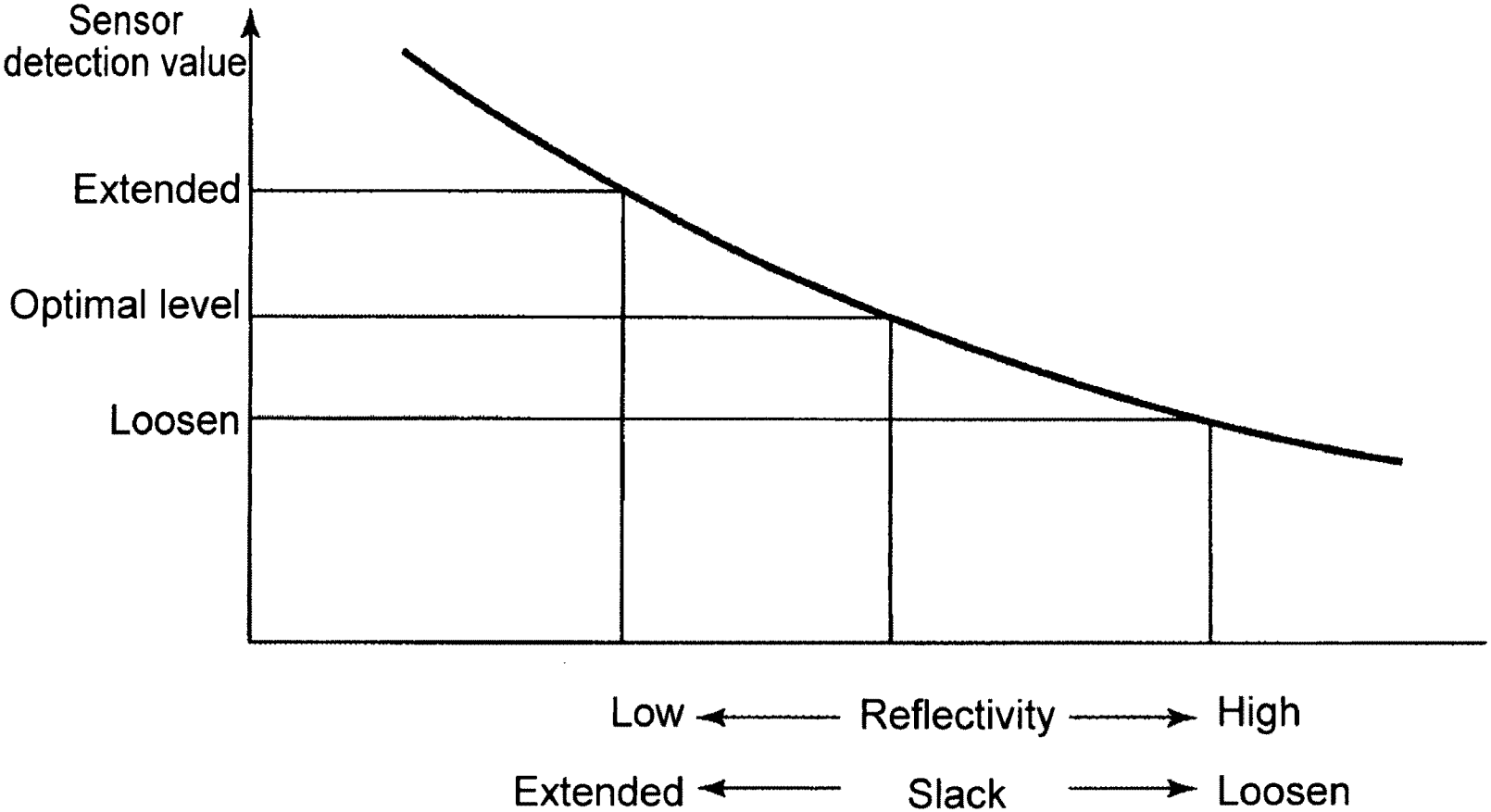
FIG. 11 is a graph showing a relationship between a detection voltage value of a density sensor and a density patch according to the second embodiment of the present invention.
Figure 12:
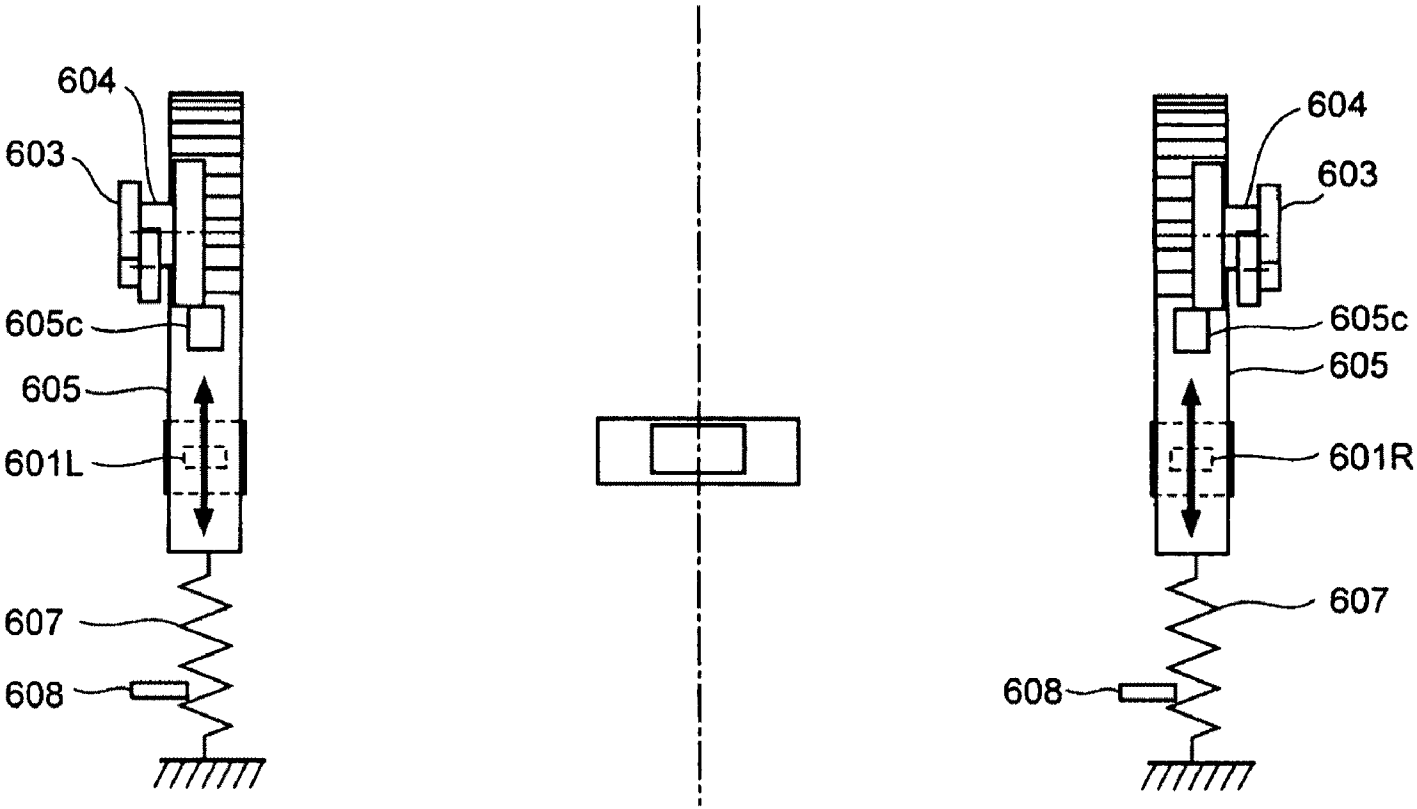
FIG. 12 is a schematic plan view showing the configuration of the slack detection mechanism according to the second embodiment of the present invention.

FIG. 11 is a graph showing a relationship between a detection voltage value of a color shift sensor 601 and a reflection patch 610 according to the second embodiment of the present invention. FIG. 12 is a schematic plan view showing the configuration of the slack detection mechanism according to the second embodiment of the present invention.

In the second embodiment, the slack detection mechanism has a configuration and an arrangement different from those of the slack detection mechanism in the first embodiment.

Components in the second embodiment similar to those in the first embodiment are designated with the same reference numerals, and explanations thereof are omitted.

As shown in FIG. 9, the slack detection mechanism includes the color shift sensor 601 and the reflection patch 610 attached to the color shift sensor 601. The color shift sensor 601 is provided for correcting an overlap position of the image formed in the image forming portion 400. More specifically, the color shift sensor 601 reads a color shift correction pattern for correcting a position shift or a color shift of the toner image formed with the image forming portion 400, thereby correcting the overlap position of the image formed in the image forming portion 400.

In the embodiment, the color shift sensor 601 includes a color shift sensor 601L and a color shift sensor 601R disposed on left and right edges of the transfer belt 461 in a direction perpendicular to the moving direction thereof. The color shift sensor 601 is formed of an optical sensor capable of obtaining an output corresponding to a light reflectivity on a detection object surface, thereby detecting a difference in light reflectivity between the toner image transferred to the transfer belt 461 and the surface of the transfer belt 461. From the detection result, it is possible to correct the overlap position of the image formed in the image forming portion 400.

As shown in FIGS. 10(*a*) and 10(*b*), the reflection patches 610*a* and 610*b* have a pattern having different reflectivities. More specifically, as shown in FIG. 10(*a*), the reflection patch 610*a* has a pattern having the different reflectivities gradually changing. As shown in FIG. 10(*b*), the reflection patch 610*b* has a pattern having the different reflectivities changing stepwise.

Note that the reflection patch 610*a* shown in FIG. 10(*a*) has the pattern with a step in the reflectivity, and the actual pattern does not have the step. The reflection patch 610 is attached to the sensor plate 605 at a position facing the color shift sensor 601, so that the reflectivity thereof changes in the movable direction of the sensor plate 605.

In the embodiment, the reflection patch 610 has the pattern having the reflectivity gradually increasing from the edge portion 605*d* of the sensor plate 605 on a side thereof where the reflection patch 610 is attached toward the rectangular hole 605*c*. When the reflectivity of the pattern at the position facing the color shift sensor 601 is high, it is indicated that the medium 101 is loosen. When the reflectivity of the pattern at the position facing the color shift sensor 601 is low, it is indicated that the medium 101 is extended. An operation of the sensor plate 605 will be explained later.

In the first embodiment, the slack detection mechanism of the medium 101 is disposed substantially at the center portion of the medium 101 in the width direction thereof. In the second embodiment, on the other hand, the slack detection mechanism of the medium 101 is disposed at each of the both edges of the medium 101 in the direction perpendicular to the medium transport direction. Accordingly, it is possible to detect the slack of the medium 101 at the left and the right sides thereof.

Figure 13:
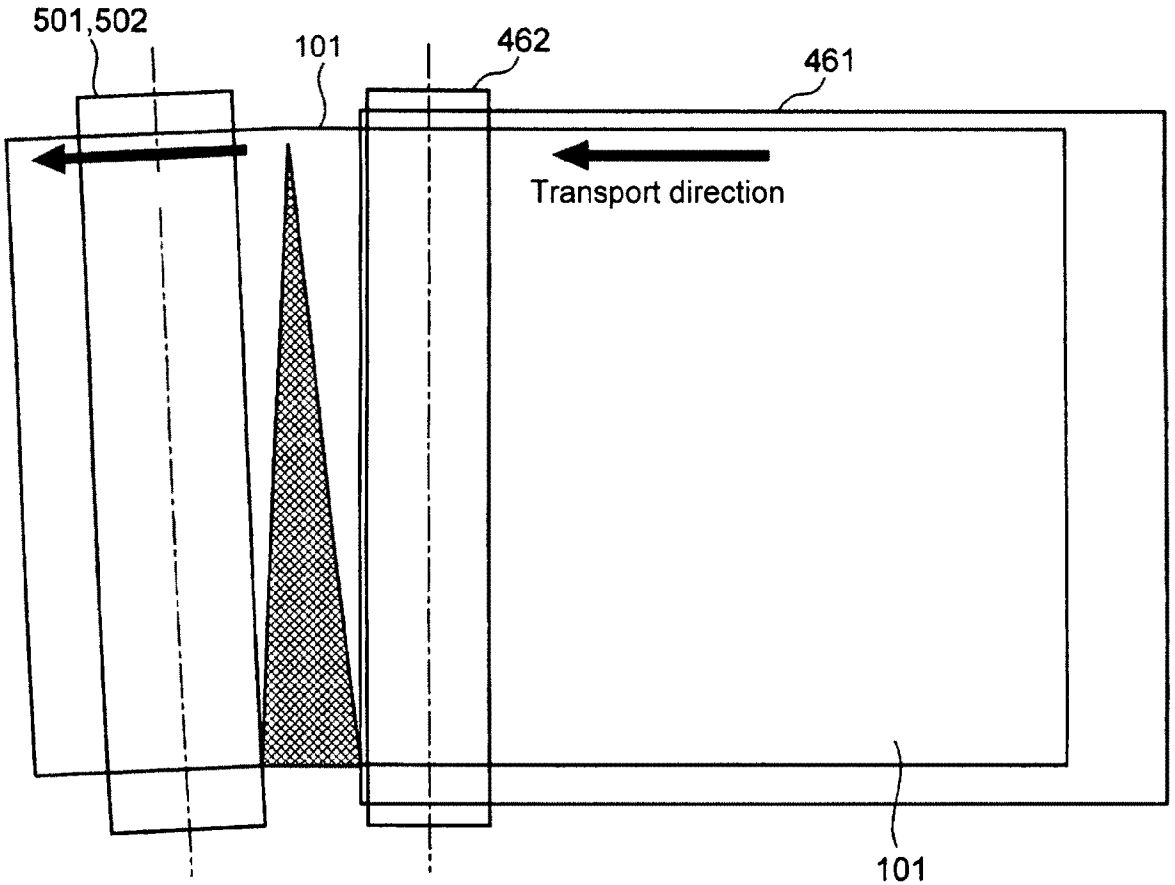
FIG. 13 is a schematic view showing a state that a medium has different slack amounts in a width direction thereof between a transfer unit and a fixing unit according to the second embodiment of the present invention.
Figure 14:
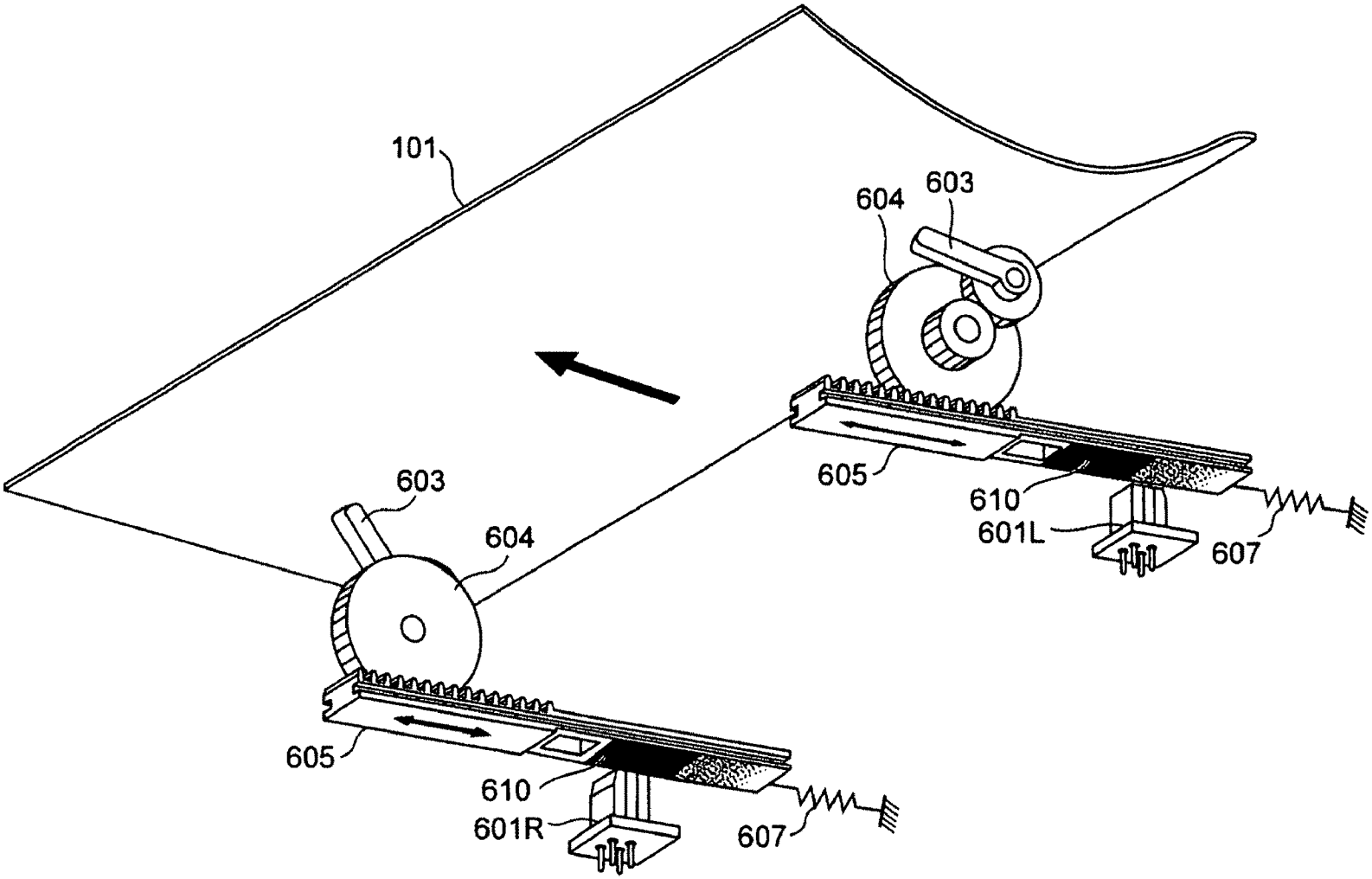
FIG. 14 is a schematic view No. 1 showing a state that the medium has different slack amounts on both edge portions thereof in a direction perpendicular to a transport direction thereof according to the second embodiment of the present invention.
Figure 15:
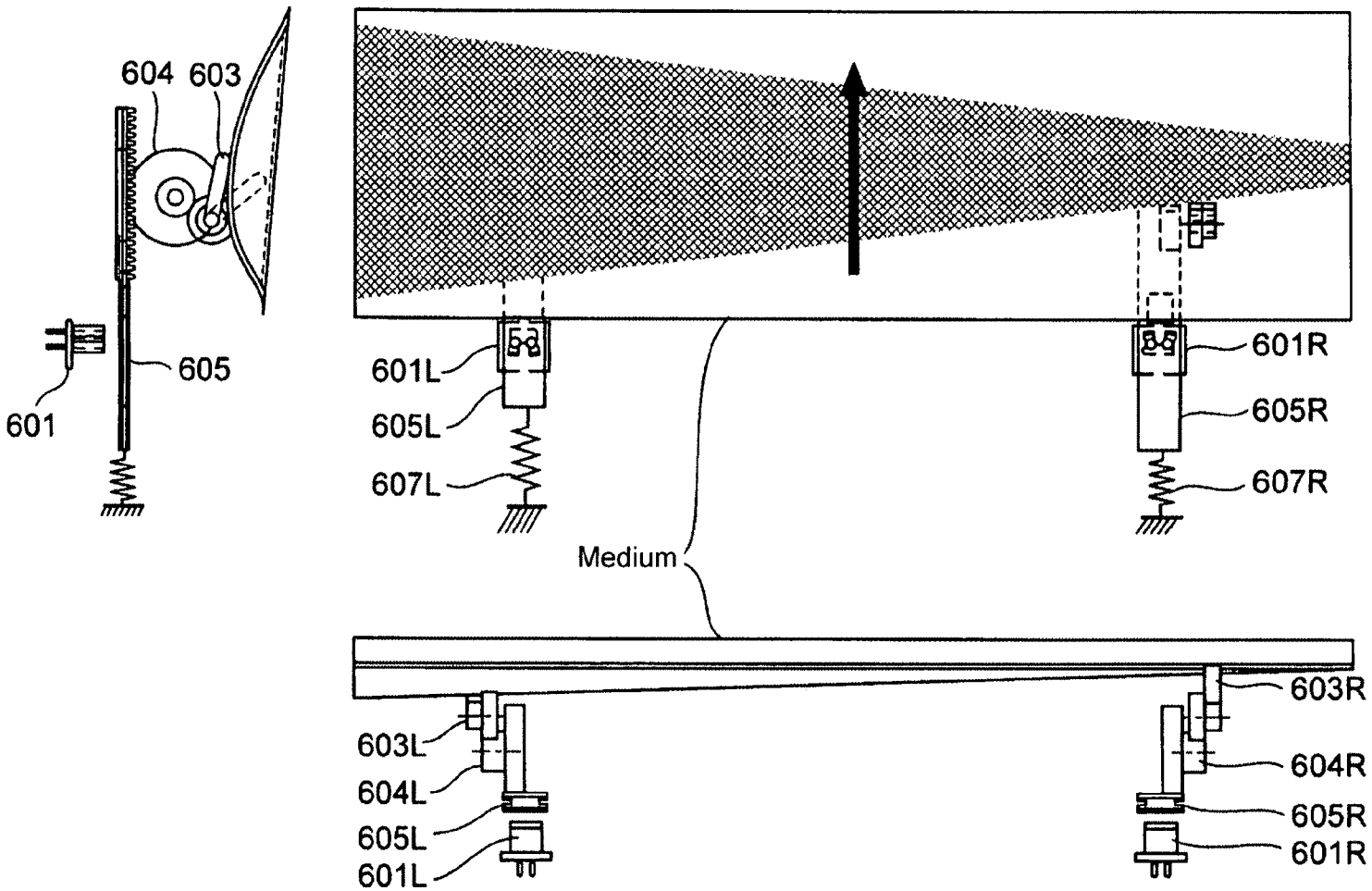
FIG. 15 is a schematic view No. 2 showing the state that the medium has different slack amounts on both edge portions thereof in a direction perpendicular to a transport direction thereof according to the second embodiment of the present invention.

An operation of the slack detection mechanism will be explained next. FIG. 13 is a schematic view showing a state that the medium 101 has different slack amounts in the width direction thereof between the transfer unit 460 and the fixing unit 500 according to the second embodiment of the present invention. FIG. 14 is a schematic view No. 1 showing a state that the medium 101 has different slack amounts on both edge portions thereof in a direction perpendicular to the transport direction thereof according to the second embodiment of the present invention. FIG. 15 is a schematic view No. 2 showing the state that the medium 101 has different slack amounts on both edge portions thereof in a direction perpendicular to the transport direction thereof according to the second embodiment of the present invention.

In the second embodiment, the slack detection mechanism detects the slack amount of the medium 101 similarly to that in the first embodiment, except that the color shift sensor 601 functions as the detecting unit for detecting the slack amount.

In the embodiment, the color shift sensor 601 is disposed on each of the both sides of the medium 101 in the width direction thereof substantially in a symmetrical arrangement, thereby making it possible to detect the slack amounts of the medium 101 on both edge portions thereof. Accordingly, as shown in FIG. 13, it is possible to detect the slack amounts of the medium 101 in the width direction thereof between the transfer unit 460 and the fixing unit 500.

When the drive roller 462 of the transfer unit 460 is arranged not exactly in parallel to the upper roller 501 of the fixing unit 500, the medium 101 is transported in a direction slight shifted. In this case, the medium 101 may have different slack amounts in the width direction thereof between the transfer unit 460 and the fixing unit 500.

As shown in FIGS. 14 and 15, when the medium 101 has different slack amounts on the both edge portions thereof in the direction perpendicular to the transport direction thereof, even though the slack amount of the medium 101 is detected at the center portion of the medium 101, it is difficult to detect the slack amounts of the medium 101 on the both edge portions thereof in the width direction thereof.

Figure 16:
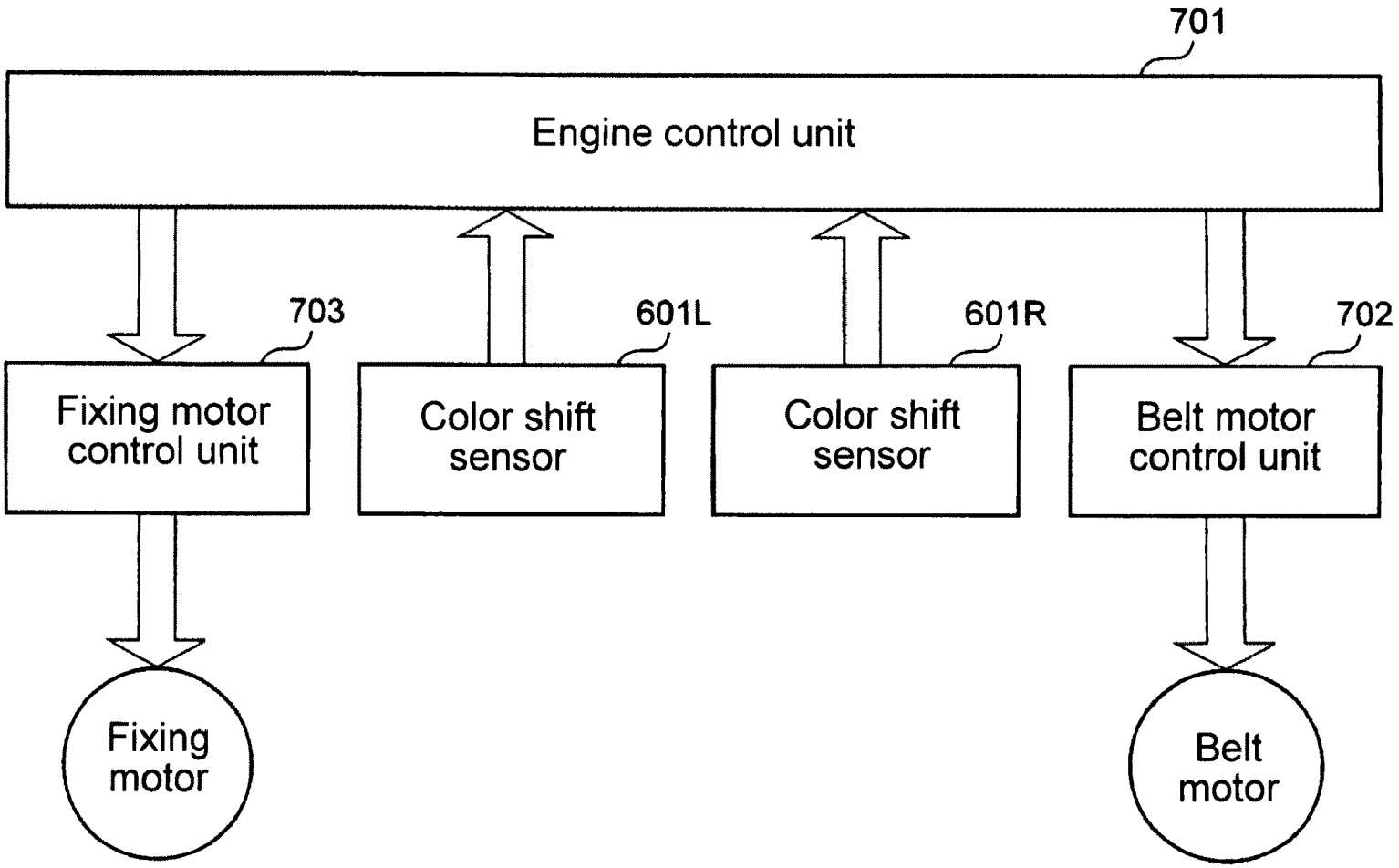
FIG. 16 is a block diagram showing the slack detection mechanism according to the first embodiment of the present invention.

FIG. 16 is a block diagram showing the slack detection mechanism according to the first embodiment of the present invention. As described above, the color shift sensor 601 is disposed on each of the both sides of the medium 101 in the width direction thereof substantially in the symmetrical arrangement, thereby making it possible to detect the slack amounts of the medium 101 on both edge portions thereof. Then, the transport speed Vf is adjusted according to a detection value on a side of a smaller slack amount of the medium 101.

In the second embodiment, similar to the first embodiment, the sensor output levels or the reflectivities are classified to levels. The slack amount corresponding to a specific level is feedback to the transport speed Vf of the fixing unit 500, thereby performing a constant value control to maintain the slack amount at a constant level. Similar to the first embodiment, the engine control unit 701 may calculate the transport speed Vf using a specific conversion formula from the density detection value detected with the density sensor 602 at a specific timing.

Further, in the embodiment, it is configured to notify with an alarm when the detection values of the slack amounts on the left and right sides have a difference larger than a specific value. When the medium 101 has the slack amounts on the both edge portions thereof having a difference larger than a specific value, the medium 101 is significantly skewed in the image forming apparatus. In this case, it is difficult to correct the skew only through adjusting the transport speed Vf. Accordingly, with the alarm, it is possible for an operation to confirm a state of the image forming apparatus for restoring the operation such as a placement state of the medium 101, a state of the transport path of the image forming apparatus, and the likes.

In the embodiment, the slack detection mechanism is disposed near the edge portion of the medium 101 in the width direction thereof, i.e., the direction perpendicular to the transport direction of the medium 101 mostly used in the image forming apparatus, thereby making it possible to accurately detect the slack. Alternatively, the slack detection mechanism may be disposed at an edge portion of a medium having a minimum width that the image forming apparatus is capable of printing. Accordingly, it is possible to detect a slack of all media that the image forming apparatus is capable of printing. Further, the sensor lever 603 may be disposed to be movable in the direction perpendicular to the medium transport direction, so that the sensor lever 603 is positioned according to the edge portion of the medium to be printed in the width direction thereof.

As described above, in the image forming apparatus in the embodiment, the slack detection mechanism is disposed near the edge portions of the medium 101 in the direction perpendicular to the transport direction of the medium 101 substantially in the symmetrical arrangement with the substantially center portion of the transport path as the symmetry center. Accordingly, it is possible to detect the slack amounts of the medium 101 on the both edge portions thereof in the width direction thereof.

In the embodiment, the transport speed Vf is adjusted according to the detection value on the side of the smaller slack amount of the medium 101. Accordingly, even when the medium 101 has the slacks on the left and right sides thereof, it is possible to prevent the image from be shifted due to excessive extension of the medium, or to prevent a transport motor from being detached. Further, when the medium 101 has the slack amounts on the both edge portions thereof having a difference larger than a specific value, it is possible to notify the operator of the abnormality of the image forming apparatus.

In the embodiments described above, the slack detection mechanism is disposed at the one position at the center portion, or at the two positions at the edge portions of the medium 101. The position of the slack detection mechanism is not limited thereto, and may be, for example, the center portion and one of the edge portions, the three positions of the center portion and the edge portions, or one of the edge portions.

The disclosure of Japanese Patent Application No. 2008-086383, filed on Mar. 28, 2008, is incorporated in the application by reference.

While the invention has been explained with reference to the specific embodiments of the invention, the explanation is illustrative and the invention is limited only by the appended claims.

What is claimed is:

1. An image forming apparatus comprising:

an image forming portion for forming an image formed of developer;

a transfer unit having a transfer belt, said transfer unit being adapted to transfer the image to the transfer belt and a medium transported on the transfer belt;

an image detection unit for detecting the image transferred to the transfer belt; and a displacement unit disposed to be displaced according to a slack amount of the medium so that the image detection unit detects a displacement amount of the displacement unit as the slack amount of the medium.

2. The image forming apparatus according to claim 1, wherein said displacement unit includes a lever member for contacting with the medium to be inclined at a specific incline angle according to the slack amount of the medium, and a plate member disposed to be movable in a direction parallel to a direction that the medium is transported for a specific movement amount according to the incline angle when the lever member is inclined, said image detection unit being adapted to detect the movement amount of the plate member as the slack amount of the medium.

3. The image forming apparatus according to claim 2, wherein said plate member includes a density patch pattern on a surface thereof facing the image detection unit, said density patch pattern having a density changing in the direction parallel to the direction that the medium is transported.

4. The image forming apparatus according to claim 2, wherein said plate member includes a reflection patch pattern on a surface thereof facing the image detection unit, said reflection patch pattern having a reflectivity changing in the direction parallel to the direction that the medium is transported.

5. The image forming apparatus according to claim 2, wherein said plate member includes an opening portion, said image detection unit being adapted to detect the image transferred to the transfer belt through the opening portion.

6. The image forming apparatus according to claim 1, wherein said image detection unit is adapted to detect a density of the image transferred to the transfer belt.

7. The image forming apparatus according to claim 1, wherein said image forming portion is adapted to form at least a first image in a first color and a second image in a second color different from the first color, said image detection unit being adapted to detect a color shift amount between the first image and the second image transferred to the transfer belt.

8. The image forming apparatus according to claim 1, wherein said image detection unit and said displacement unit are arranged at a downstream side of the image forming portion in a direction that the medium is transported.

9. The image forming apparatus according to claim 1, wherein said image detection unit and said displacement unit are arranged at a position corresponding substantially to a center portion of the transfer belt.

10. The image forming apparatus according to claim 1, wherein said image detection unit includes a first image detection unit and a second image detection unit, and said displacement unit includes a first displacement unit and a second displacement unit, said first image detection unit and said first displacement unit being arranged on one end portion of the transfer belt in a direction perpendicular to a direction that the medium is transported, said second image detection unit and said second displacement unit being arranged on the other end portion of the transfer belt in a direction perpendicular to the direction that the medium is transported.

11. The image forming apparatus according to claim 1, further comprising a control unit for controlling a transportation speed of the medium according to the slack amount detected with the image detection unit.

* * * * *